US010421076B2

(12) United States Patent
Bach et al.

(10) Patent No.: US 10,421,076 B2
(45) Date of Patent: Sep. 24, 2019

(54) DRUM CUTTING MACHINE AND BLADE BOX FOR SUCH A MACHINE

(75) Inventors: Alexander Bach, Ratzeburg (DE); Bernd Kruse, Schneverdingen (DE); Wolfgang Brümmer, Mölln (DE)

(73) Assignee: F.H. Schule Muhlenbau GmbH, Reinbek (DE)

( * ) Notice: Subject to any disclaimer, the term of this patent is extended or adjusted under 35 U.S.C. 154(b) by 1122 days.

(21) Appl. No.: 13/487,575

(22) Filed: Jun. 4, 2012

(65) Prior Publication Data

US 2012/0305689 A1 Dec. 6, 2012

(30) Foreign Application Priority Data

Jun. 3, 2011 (DE) ..... 10 2011 105 321

(51) Int. Cl.
*B02C 9/02* (2006.01)

(52) U.S. Cl.
CPC ..... *B02C 9/02* (2013.01)

(58) Field of Classification Search
CPC ..... B02C 9/02; B02C 9/00
USPC ..... 241/88.1, 88.4, 95, 135, 141, 142, 222, 241/242
See application file for complete search history.

(56) References Cited

U.S. PATENT DOCUMENTS

| | | | | |
|---|---|---|---|---|
| 540,570 | A * | 6/1895 | Arnfield | 19/95 |
| 792,485 | A * | 6/1905 | Williams | 241/95 |
| 1,170,389 | A * | 2/1916 | Armstrong | 19/95 |
| 1,182,575 | A * | 5/1916 | Langevin | 19/95 |
| 1,423,867 | A * | 7/1922 | Winston, et al. | 241/167 |
| 1,672,945 | A * | 6/1928 | Kipp, Jr. | 241/274 |
| 2,215,226 | A * | 9/1940 | Meyer | 241/88.4 |
| 5,402,948 | A * | 4/1995 | Kaczmarek | 241/73 |
| 5,526,988 | A * | 6/1996 | Rine | 241/23 |
| 5,779,167 | A * | 7/1998 | Wagstaff | 241/242 |
| 6,536,691 | B2 * | 3/2003 | Prewitt et al. | 241/86.1 |
| 6,547,170 | B2 * | 4/2003 | Byrd et al. | 241/30 |
| 8,146,849 | B2 * | 4/2012 | Bacon | 241/294 |

FOREIGN PATENT DOCUMENTS

NL 106992 10/1923

* cited by examiner

*Primary Examiner* — James S. McClellan
*Assistant Examiner* — Peter J Iannuzzi
(74) *Attorney, Agent, or Firm* — Alix, Yale & Ristas, LLP

(57) ABSTRACT

A drum cutting machine has a rotary drum and has a plurality of blades arranged along the contour of the rotary drum. The lateral surface of the rotary drum is provided with a multiplicity of holes. A supporting part matches the contour of the rotary drum and has for each of the blades a bearing point that defines the position of the cutting edge. A blade box for such a machine makes it easier to move the blades into the correct position, thereby reducing the complexity in terms of maintenance.

20 Claims, 4 Drawing Sheets

DRUM CUTTING MACHINE AND BLADE BOX FOR SUCH A MACHINE

BACKGROUND

The invention relates to a drum cutting machine having a rotary drum. The lateral surface of the rotary drum is provided with a multiplicity of holes. Arranged along the contour of the rotary drum are a plurality of blades. The invention also relates to a blade box for such a drum cutting machine.

Such machines are used for grinding cereal grains. The cereal grains are introduced into the interior of the rotary drum and move toward the outside through the holes provided in the lateral surface of the rotary drum. The blades are arranged in the immediate vicinity of the lateral surface of the rotary drum. As soon as a cereal grain projects out through the hole, it comes into contact with one of the blades by rotation of the rotary drum, and so a part of the cereal grain is cut off.

For proper functioning, it is important for the blades to be positioned precisely in relation to the rotary drum. For this purpose, in previous drum cutting machines there is provided a blade box, the shape of which roughly matches the contour of the rotary drum. The precise position of the blades is defined by shims. The positioning of the shims and the fastening of the blades require fine adjustment, which is carried out manually in a time-consuming manner. Since the fine adjustment has to be carried out individually for each blade, a high degree of complexity results overall.

SUMMARY

A drum cutting machine, in which the complexity in terms of reduced maintenance, is provided. According thereto, there is provided a supporting part which matches the contour of the rotary drum and has for each of the blades a bearing point that defines the position of the cutting edge.

This has the advantage that there is provided an individual supporting part, via which the position of a plurality of blades is defined directly. The attachment of the blades to the supporting part no longer requires any fine adjustment by a qualified technician, but becomes a simple routine technical activity.

One supporting part is usually not enough to hold the blade securely. Therefore, there is preferably provided a second supporting part which likewise has for each of the blades a bearing point that defines the position of the cutting edge. Each of the supporting parts can be arranged adjacently to one of the end faces of the rotary drum. The blades can then extend along the rotary drum from the first supporting part to the second supporting part.

The supporting part can be designed such that the cutting edge of the blade rests against the bearing point. However, the orientation of the entire blade changes when the cutting edge is deformed in the region of the bearing point. Therefore, in a preferred embodiment, the supporting part has two bearing points for each blade. The two bearing points can act on different surfaces of the blade, for example on the two surfaces which adjoin the cutting edge. The position of the cutting edge in the supporting part is then defined not by the cutting edge itself but by the surfaces adjoining the cutting edge.

Although the position of the cutting edge can be defined unambiguously by two bearing points, the angle of incidence of the cutting edge cannot be readily defined unambiguously thereby. Therefore, the supporting part can have two bearing surfaces for each blade. There can be planar contact between the two bearing surfaces and two surfaces of the blade, so that both the position and the angle of incidence of the cutting edge are defined unambiguously.

The two surfaces of the blade, on which the two bearing surfaces of the supporting part rest, can be the surfaces which adjoin the cutting edge. Since it is not easy to exactly render the sharp cutting edge of the blade in the supporting part, the bearing surfaces preferably do not extend as far as the cutting edge directly. This means that there is no contact between the bearing surfaces and the blade in the immediate vicinity of the cutting edge.

In order to fasten the blade to the supporting part, the supporting part can have an undercut in the radial direction. By way of a suitable fastening means, such as a screw, for example, which engages behind the undercut, the blade can be pulled against the supporting part and as a result fixed.

In an advantageous embodiment, the supporting part has an elongate undercut which extends substantially parallel to the contour of the rotary drum. The undercut then forms a rail, along which the fastening means can be guided into a position suitable for fastening a blade. At this point, the fastening means is tensioned.

In order to fasten the supporting part to the machine, it is favorable for the supporting part to be an element of a structural element which can be connected in its entirety to the machine. Preferably, the structural element consists of two side plates and an intermediate plate, at least one of the side plates being in the form of a supporting part within the meaning of the invention. If each of the side plates has an undercut and the side plates are held at a suitable distance from one another by the intermediate plate, the fastening means can be supported on both undercuts at the same time and extend through between the two side plates in the direction of the blade.

The blades should be oriented such that they extend parallel to the axis of the rotary drum and such that the cutting edges are at as small a distance as possible from the lateral surface of the rotary drum. The distance can be for example between 0.1 mm and 0.2 mm. A rotary drum can be assigned for example at least 10, preferably at least 20 blades. For each of the blades, the supporting part has bearing points, by way of which the position of the cutting edge is defined. The blades are arranged close together and can extend altogether over a circumferential angle of the rotary drum of at least 45°, preferably at least 90°, more preferably at least 135°. An extent over a circumferential angle of more than 240° is not desired as a rule. In the operating state of the drum cutting machine, the blades are arranged predominantly underneath the rotary drum. The drum cutting machine can be equipped with more than one rotary drum. The plurality of rotary drums can be driven by a common shaft.

Depending on the use purpose, different sizes of the fragments produced by way of the drum cutting machine are desired. Generally, three sizes are distinguished, specifically fine cut, medium cut and coarse cut. The smallest fragments are produced in the fine cut and the largest in the coarse cut. The size of the fragments depends on the extent to which the cereal grain can move out of the hole after the preceding fragment has been cut off before it comes into contact with the next blade. This depends on how the rear surface, facing the rotary drum, of the blade is oriented. After the preceding fragment has been cut off, the remaining cereal grain is guided on the rear surface of the blade in question. Depending on the angle of incidence of the rear surface, the cereal grain can emerge to a greater or lesser extent from the hole before it comes into contact with the next blade. If the rear surface is oriented virtually parallel to the lateral surface of the rotary drum, the cereal grain can move only a little and small fragments are produced. If the angle of incidence is greater, larger fragments are produced. Angle of incidence means that the distance between the rotary drum and the rear surface increases, the greater the distance from the cutting edge is.

In order to produce fragments of uniform size, the supporting parts should be set up such that the cutting edges are at the same distance from the rotary drum for all of the blades. Furthermore, the angle of incidence should be the same for all of the blades. For example, the angle of incidence can be between 2° and 15°, preferably between 3° and 12°. The smaller angles within this range lead to fine cut and the larger angles to coarse cut.

In order to enable a quick changeover of the drum cutting machine between fine cut, medium cut and coarse cut, the drum cutting machine can be equipped with a blade box, which can be easily exchanged as a unit. The blade box comprises two supporting parts and also a plurality of blades fastened to the supporting parts, the blades being fastened in the positions defined by the bearing points of the supporting parts. In an advantageous embodiment, the drum cutting machine comprises a set of blade boxes, the blades of the different blade boxes having different angles of incidence. The set can comprise for example a first blade box for fine cut, in the case of which the angle of incidence is between 2° and 5°. In the case of a second blade box intended for medium cut, the angle of incidence can be between 5° and 8°. In the case of a third blade box for coarse cut, the angle of incidence can be between 9° and 12°.

The disclosure also relates to a blade box for such a drum cutting machine. The blade box comprises two supporting parts which are arranged at a distance from one another that matches the rotary drum, and also a plurality of blades, which are each fastened to the two supporting parts and the position of which is defined by bearing points of the supporting parts. The blade box can be combined with further features which are described above with reference to the drum cutting machine.

BRIEF DESCRIPTION OF THE DRAWINGS

The invention is described in the following text by way of example on the basis of an advantageous embodiment and with reference to the appended drawings, in which.

DETAILED DESCRIPTION

Figure 1:
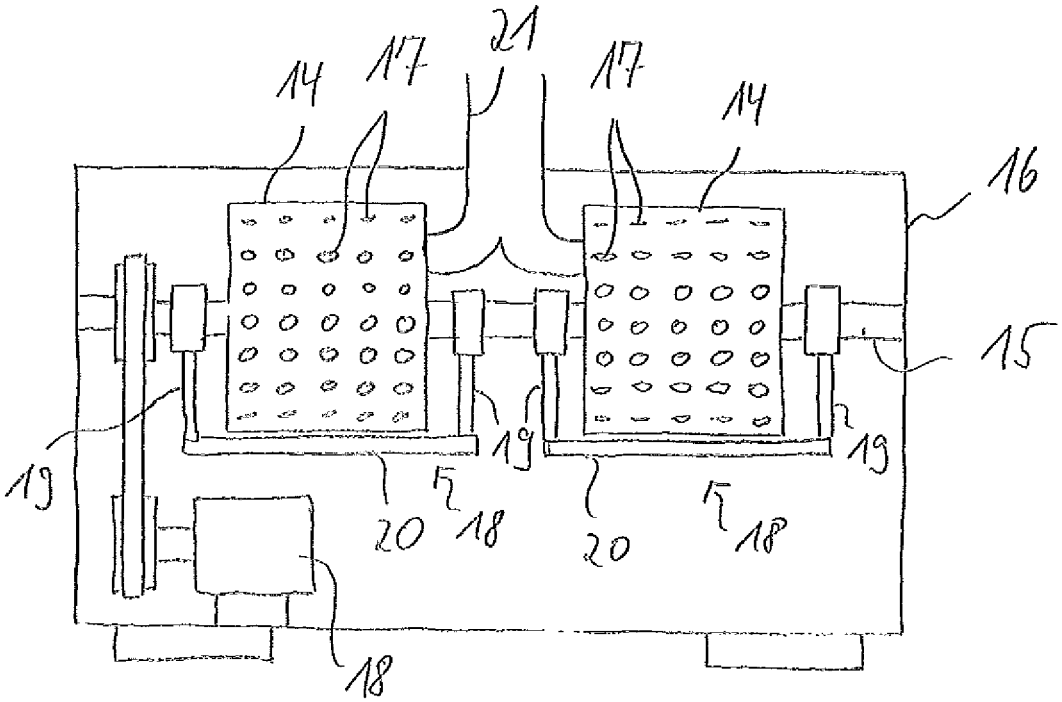
FIG. 1 shows a schematic sectional view of a drum cutting machine.

In the case of a drum cutting machine in FIG. 1, a shaft 15 is mounted in a rotatable manner in a machine housing 16. Fastened to the shaft 15 are two rotary drums 14, the lateral surfaces of which are provided with a multiplicity of holes 17. The diameter of the holes 17 is selected such that cereal grains can pass straight through. The shaft 15 having the rotary drums 14 can be set into rotation via an electric motor 18. When the machine is in operation, the rotational speed is around 50 rpm.

Figure 2:
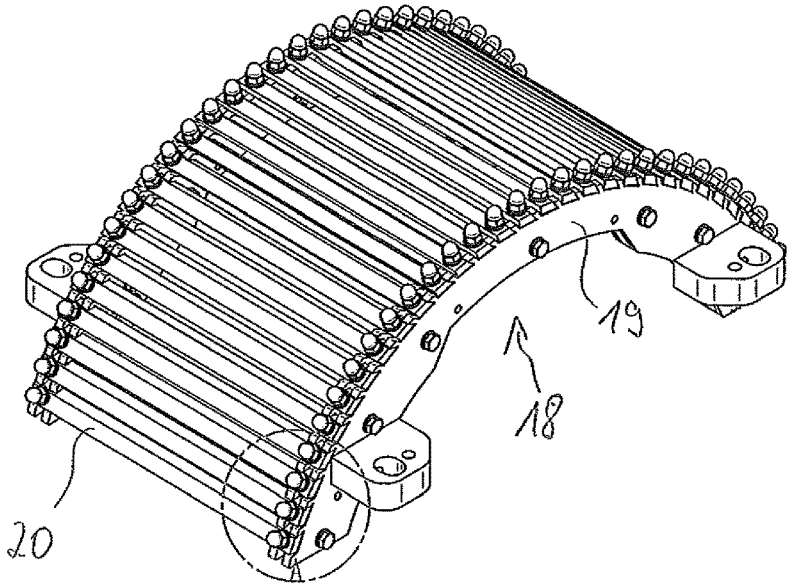
FIG. 2 shows a plan view of a blade box.

The lower part of the two rotary drums 14 is surrounded in each case by a blade box 18, as is shown in a perspective illustration in FIG. 2. The blade box 18 is composed of two structural elements 19, to which a multiplicity of blades 20 are fastened. The structural elements 19 are arranged parallel to the two end faces of the rotary drum 14 and match the circular contour of the end faces. The blades 20, which extend between the two structural elements 19, are held at a small distance from the lateral surface of the rotary drum 14. In this exemplary embodiment, the blade box 18 comprises thirty blades 20, which are all parallel to one another and are arranged at a small distance from the lateral surface of the rotary drum 14. Altogether, the blades 20 cover approximately the lower half of the rotary drum 14.

Cereal grains can be fed into the interior of the rotary drum 14 through a connecting piece 21. The cereal grains drop into the lower part of the rotary drum under the force of gravity. By rotation of the rotary drum 14, the cereal grains are kept in motion, so that cereal grains continuously come into the correct position and orientation in order to pass into one of the holes 17. The cereal grains then move through the holes 17 toward the outside, until they project through the lateral surface of the rotary drum 14. By rotation of the rotary drum 14, the cereal grain is brought into contact with one of the blades 20, and so a part of the cereal grain is cut off. The remaining part of the cereal grain moves further out until contact is again made with one of the blades 20 and a further part of the cereal grain is cut off. The fragments of the cereal grains are collected under the rotary drums 14 and transported away for further use.

Figure 5:
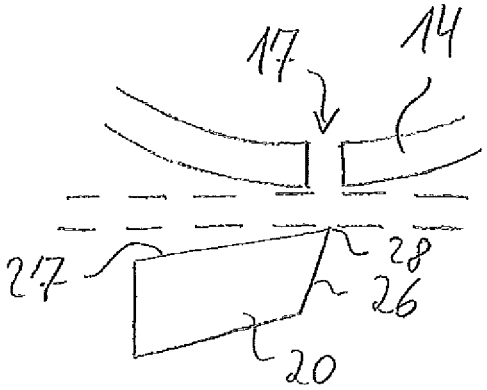
FIG. 5 shows a schematic illustration of a rotary drum and a blade.

The schematic illustration in FIG. 5 shows a detail of the rotary drum 14 having a hole 17 and also a blade 20 arranged under the rotary drum 14. The blades 20 are set up such that the distance between the cutting edge 28 and the lateral surface of the rotary drum is as small as possible. In practice, the distance, as is indicated by the dashed line, is about 1 mm. The angle of incidence of the rear surface 27 of the blade 20 sets the extent to which the remaining cereal grain can move out of the holes 17 before it comes into contact with the next blade 20. The greater the angle of incidence between the rear surface 27 and the tangent, indicated by a dashed line, to the rotary drum 14, the larger the fragment of the cereal grain that is cut off by the following blade 20. For the drum cutting machine of the exemplary embodiment, there are provided three blade boxes 18, in the case of which the inclination angle of the blades 20 is different. In the case of the first blade box 18, which is provided for fine cut, the inclination angle is about 4°. In the case of the second blade box 18, which is provided for medium cut, the inclination angle is about 7.5°. In the case of the third blade box 18, which is provided for coarse cut, the inclination angle is about 11°.

The cereal grains are cut only in the lower half of the rotary drum 14. If a cereal grain remains in one of the holes 17 after the region of the blades 20 has been left, the cereal grain drops out of the hole 17 again and into the interior of the rotary drum 14 under the influence of gravity. In order to support this, there may be provided a needle drum, the needles of which engage in the holes 17 in order also to free stuck cereal grains from the holes 17.

Figure 3:
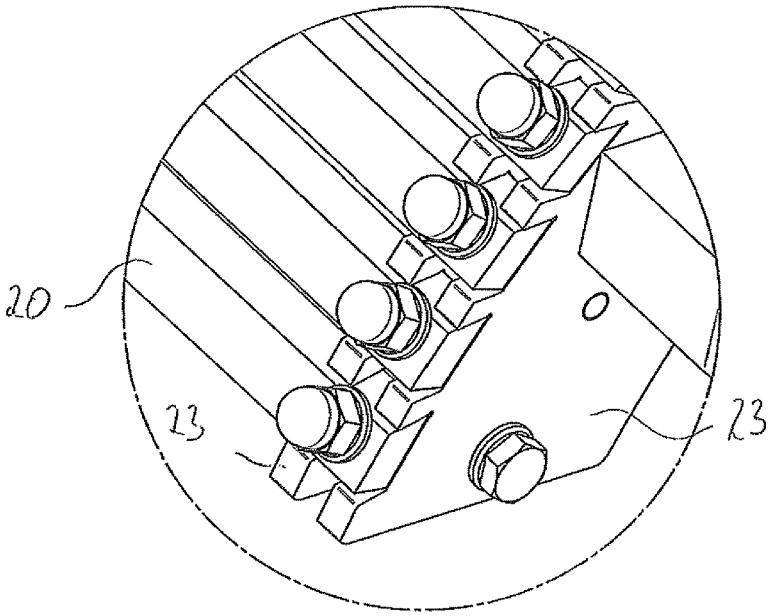
FIG. 3 shows an enlarged detail from FIG. 2.
Figure 4:
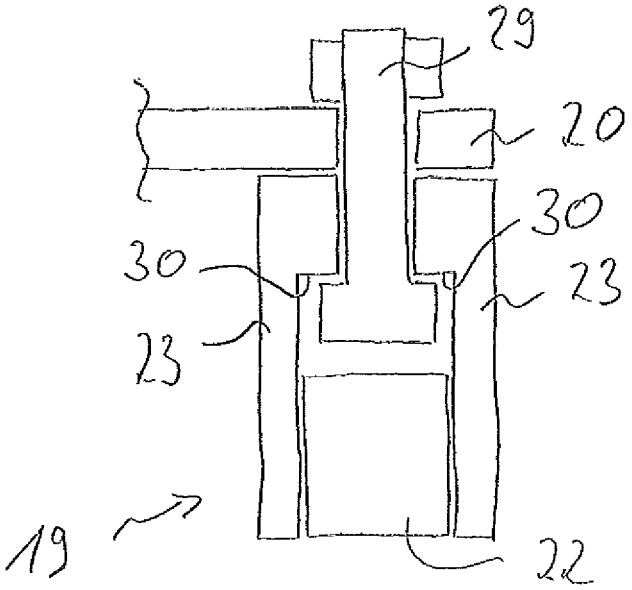
FIG. 4 shows a sectional illustration of a detail of a blade box.
Figure 6:
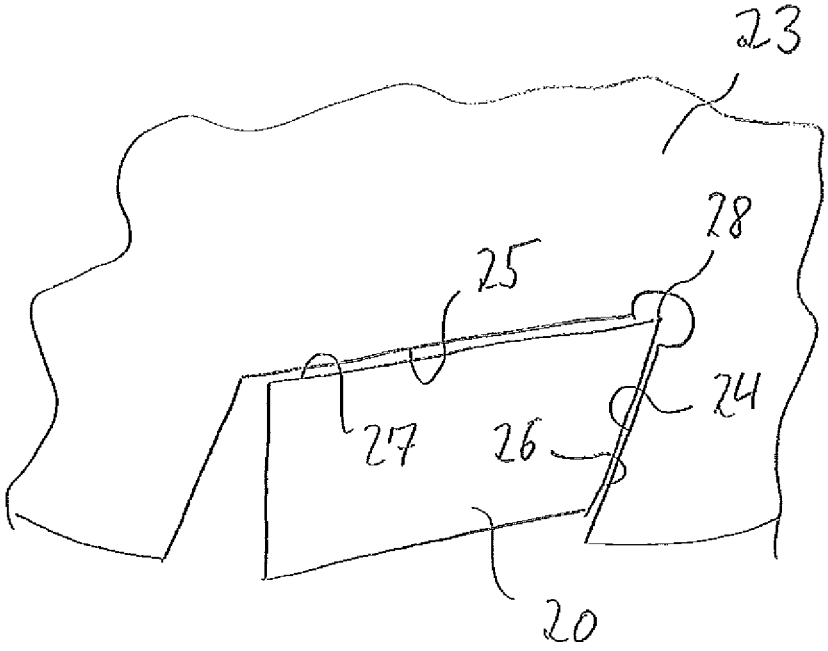
FIG. 6 shows a detail of a supporting part having a blade.

As FIGS. 3 and 4 show, the structural element 19 is composed of three components, specifically of two side plates and an intermediate plate 22 arranged between the side plates. The side plates have a substantially semicircular contour which corresponds to the lateral surface of the rotary drum 14. A blade holder for each of the blades 20 is formed in each case in the side plates, so that the side plates each form a supporting part 23 within the meaning of the invention. As is shown in an enlarged illustration in FIG. 6, each blade holder comprises two bearing surfaces 24, 25, of which one rests on the front surface 26 and one on the rear surface 27 of the blade 20. By way of the bearing surfaces 24, 25, both the position of the cutting edge 28 of the blade and the orientation of the front surface 26 and the rear surface 27 are defined unambiguously. The bearing surfaces 24, 25 do not extend as far as the cutting edge 28 but maintain a distance by way of a circular cutout.

According to FIG. 4, the supporting parts 23 each have an undercut 30 in the radial direction. By way of the intermediate plate 22, the supporting parts 23 are kept at a distance from one another such that an outwardly extending screw is retained at the undercuts 30 by way of its head. The screw is guided through a hole in the blade 20 and thus forms a fastening element 29 for the blade 20. The undercuts 30 extend parallel to the contour of the supporting parts 23, thereby forming a rail, along which the screw can be displaced. As a result, the screw can tensioned against the blade 20 in any desired position, i.e. in particular in the position defined by the bearing surfaces 24, 25. It thus takes a simple routine technical activity to assemble a blade box 18 from the supporting parts 23 and the appropriate number of blades 20.

The invention claimed is:

1. A drum cutting machine having a rotary drum defining an axis, with a generally circumferential lateral surface having a contour, and a plurality of blades with a cutting edge arranged along the lateral surface of the rotary drum, the lateral surface of the rotary drum being provided with a multiplicity of holes, wherein the blades are supported by a supporting part which matches the contour of the lateral surface, the supporting part is a one-piece element having a first bearing surface and a second bearing surface for each blade, and the first and second bearing surfaces are in contact with each of the blades and define a position of the cutting edge.

2. The drum cutting machine as claimed in claim 1, wherein the rotary drum has end faces on opposite axial ends and there are provided two supporting parts, and wherein the supporting parts are arranged adjacently to the end faces of the rotary drum.

3. The drum cutting machine as claimed in claim 1, wherein the supporting part has two bearing points for each blade, and wherein the bearing points are in contact with different surfaces of the blade.

4. The drum cutting machine as claimed in claim 1, wherein there is planar contact between the bearing surfaces and two different surfaces of the blade.

5. The drum cutting machine as claimed in claim 4, wherein the first and second bearing surfaces of the supporting part are in contact with those surfaces of the blade that adjoin the cutting edge, there being no contact with the bearing surfaces in a part of the surfaces that directly adjoins the cutting edge.

6. The drum cutting machine as claimed in claim 1, wherein the supporting part has an undercut in the radial direction from said axis, a fastening element of a blade engaging behind said undercut.

7. The drum cutting machine as claimed in claim 6, wherein the undercut extends parallel to the contour of the lateral surface.

8. The drum cutting machine as claimed in claim 1, wherein the supporting part is a component of a structural element composed of two side plates and an intermediate plate, the side plates being held at a distance from one another by the intermediate plate.

9. The drum cutting machine as claimed in claim 1, wherein there is provided a blade box which is exchangeable as a unit and comprises the supporting part and also the blades fastened thereto.

10. The drum cutting machine as claimed in claim 9, wherein a set of blade boxes to be used alternately is provided, the blades of the different blade boxes having different inclination angles.

11. A blade box for a drum cutting machine comprising a rotary drum with a generally circumferential lateral surface having a contour and a length and having two supporting parts which match the contour of the lateral surface of a drum cutting machine and which are arranged at a distance from one another that matches the length of the rotary drum, and having a plurality of blades with a cutting edge, which are each fastened to the two supporting parts, wherein the supporting parts for the plurality of blades are one-piece elements that have a first bearing surface and a second bearing surface for each blade, and the first and second bearing surfaces are in contact with the blades and define a position of the cutting edges.

12. The drum cutting machine as claimed in claim 2, wherein the supporting part has two bearing points for each blade, and wherein the bearing points are in contact with different surfaces of the blade.

13. The drum cutting machine as claimed in claim 2, wherein there is planar contact between the bearing surfaces and two different surfaces of the blade.

14. The drum cutting machine as claimed in claim 3, wherein there is planar contact between the bearing surfaces and two different surfaces of the blade.

15. The drum cutting machine as claimed in claim 2, wherein the supporting part has an undercut in the radial direction from said axis, a fastening element of a blade engaging behind said undercut.

16. The drum cutting machine as claimed in claim 3, wherein the supporting part has an undercut in the radial direction from said axis, a fastening element of a blade engaging behind said undercut.

17. The drum cutting machine as claimed in claim 4, wherein the supporting part has an undercut in the radial direction from said axis, a fastening element of a blade engaging behind said undercut.

18. The drum cutting machine as claimed in claim 2, wherein the supporting part is a component of a structural element composed of two side plates and an intermediate plate, the side plates being held at a distance from one another by the intermediate plate.

19. The drum cutting machine as claimed in claim 3, wherein the supporting part is a component of a structural element composed of two side plates and an intermediate plate, the side plates being held at a distance from one another by the intermediate plate.

20. The drum cutting machine as claimed in claim 1, wherein the lateral surface is substantially cylindrical.

* * * * *